US005503646A

United States Patent [19]

McKenny et al.

[11] Patent Number: 5,503,646

[45] Date of Patent: Apr. 2, 1996

[54] PROCESS FOR COAL - HEAVY OIL UPGRADING

[75] Inventors: Colin J. McKenny; Brian W. Raymond, both of Calgary, Canada

[73] Assignees: Fording Coal Limited; PanCanadian Petroleum Limited, both of Calgary, Canada

[21] Appl. No.: 268,271

[22] Filed: Jun. 30, 1994

[51] Int. Cl.[6] ..... C10L 5/08

[52] U.S. Cl. ..... 44/620; 44/592; 44/608; 44/626; 44/628

[58] Field of Search ..... 44/592, 608, 620, 44/628, 502, 626; 208/434

[56] References Cited

U.S. PATENT DOCUMENTS

| | | | |
|---|---|---|---|
| 3,697,412 | 10/1972 | Brimhall . | |
| 3,754,876 | 8/1973 | Pennington et al. . | |
| 3,870,621 | 3/1975 | Arnold et al. . | |
| 4,088,562 | 5/1978 | O'Ffill . | |
| 4,105,536 | 8/1978 | Morrell . | |
| 4,111,787 | 9/1978 | Aldridge et al. . | |
| 4,146,366 | 3/1979 | Keller | 44/608 |
| 4,396,396 | 8/1983 | Mainwaring . | |
| 4,415,335 | 11/1983 | Mainwaring et al. . | |
| 4,579,562 | 4/1986 | Tarman et al. . | |
| 4,764,270 | 8/1988 | Hsieh et al. . | |
| 4,854,940 | 8/1989 | Janiak et al. . | |
| 4,886,521 | 12/1989 | Khan . | |
| 4,889,538 | 12/1989 | Mikhlin et al. . | |
| 4,935,036 | 6/1990 | Ikura et al. . | |
| 5,033,230 | 7/1991 | Kennepohl et al. . | |
| 5,162,050 | 11/1992 | Knudson . | |
| 5,338,322 | 8/1994 | Ignasiak et al. | 44/620 |

FOREIGN PATENT DOCUMENTS

| | | |
|---|---|---|
| 1216551 | 1/1987 | Canada . |
| 2022721-4 | 8/1990 | Canada . |
| 57-128794 | 10/1982 | Japan . |
| 113079 | 2/1918 | United Kingdom . |
| 91/00020 | 8/1991 | WIPO . |

*Primary Examiner*—Prince Willis, Jr.
*Assistant Examiner*—Cephia D. Toomer
*Attorney, Agent, or Firm*—Rodman & Rodman

[57] ABSTRACT

A process for upgrading a low rank coal and a heavy oil to produce an improved coal product and an improved oil product. First, the low rank coal is dewatered to reduce its moisture content to less than about 4 percent in order to render the low rank coal more oleophilic. Next, the dewatered low rank coal is mixed with a quantity of the heavy oil of between about 15 and 40 percent of the dry weight of the low rank coal so that the heavy oil substantially contacts the low rank coal in order to produce a mixture. The mixture is then heated to a temperature less than the mild thermal cracking limit of the mixture in order to separate hydrocarbons from the mixture and to produce the improved coal product. The hydrocarbons separated from the mixture during the heating step are then collected in order to produce the improved oil product.

43 Claims, 1 Drawing Sheet

True Boiling Point Distillation
Heavy Oil versus Improved Product
(Using ASTM D1160 Method)

PROCESS FOR COAL - HEAVY OIL UPGRADING

TECHNICAL FIELD

The present invention relates to a process for upgrading a low rank coal and a heavy oil to produce both an improved coal product and an improved oil product.

BACKGROUND ART

Processes for upgrading low rank coal by using low quality bridging liquids, such as heavy oil, are well-known in the art. Canadian Patent No. 1,216,551 (Ignasiak) issued Jan. 13, 1987, is directed towards a method for agglomerating sub-bituminous coal using heavy oil. For such processes, quantities of heavy oil, in the order of 10 to 50 percent of the weight of the coal, are typically utilized. Coal is upgraded by selectively reducing the ash content and concentrating the coal.

Further processes have been developed to recover a portion of the heavy oil utilized in the agglomeration process. U.S. Pat. No. 4,854,940 (Janiak et. al.) issued Aug. 8, 1989, is directed towards a process for separating distillable hydrocarbons from sub-bituminous coal which has been agglomerated with a low quality bridging liquid by contacting the agglomerates with steam or nitrogen at temperatures between 250° C. and 350° C. Although a portion of the bridging liquid is recovered from the agglomerates by this process, the invention is directed primarily at the upgrading of the coal as a solid fuel.

Given that lighter, upgraded oils are typically more valuable than either upgraded coal or heavy oils, it is economically desirable to process mixtures of coal and heavy oil in such a manner that the heavy oil is recovered and also upgraded. Canadian Patent Application 2,022,721-4 (Ignasiak et. al.) filed Aug. 3, 1990, describes a method for recovering oil from coal fines that are agglomerated or mixed with heavy oil. The method involves heating the agglomerates or mixed coal fines to temperatures above 350° C., up to 450° C., in an inert gas atmosphere, such as steam or nitrogen, and condensing and collecting the oils distilled therefrom. The temperature range for the method is chosen to maximize the yield of distillable components while at the same time minimizing the generation of coal tars, which result from thermal cracking of the constituent hydrocarbons. Thermal cracking results in hydrocarbon products which require hydrotreating or hydrogenation before they are in a stable form, such that they are considered commercially acceptable, and are therefore not economical.

U.S. Pat. No. 4,396,396 (Mainwaring) issued Aug. 2, 1983, and U.S. Pat. No. 4,415,335 (Mainwaring et. al.) issued Nov. 15, 1983, utilize the well-known concepts and principles of vacuum and steam stripping to distill and separate out hydrocarbons from agglomerates or heavy oil/coal mixes. Stripping reduces the process temperature and increases oil yield while minimizing the effects of thermal cracking.

In the various processes used to separate hydrocarbons, the agglomerates and heavy oil/coal mixes typically contain large percentages of water which must be heated from ambient temperatures. In addition, the water contained in the agglomerates and mixes must be substantially removed in order for the agglomerates and mixes to be capable of reaching the temperatures required by these processes. Typically, as the agglomerates and mixes are heated from ambient temperatures, the water content is evaporated and the agglomerates and mixes are substantially dewatered. The dewatering of the agglomerates and mixes typically results in a significant loss of hydrocarbons with the vented steam. As well, when the agglomerates and heavy oil/coal mixes are heated to the temperature of the boiling point of water at the ambient pressure, the agglomerates and mixes can exhibit a first stage of stickiness, believed to be associated with the water, and adhere to the walls of the processing vessel, which may render them more difficult to process.

Further, in conducting these various processes to separate hydrocarbons, it has been found that the agglomerates and heavy oil/coal mixes exhibit a further or second stage of stickiness, believed to be associated with the heavy oil, following the evaporation of the water contained in them, during subsequent heating and stripping processes. Specifically, it has been found that the second stage of stickiness of the agglomerates and mixes is exhibited throughout a sticky temperature zone which is typically between about 180° C. and 260° C. Therefore, as the agglomerates or mixes are further heated, they become sticky and adhere to the walls of the processing vessel, which may render the agglomerates and mixes more difficult to process and result in plugging of the equipment used in the process.

As a result of the first and second stages of stickiness exhibited by the agglomerates and heavy oil/coal mixes during heating, the installation of mechanical scraping devices and other specialized equipment may be required. Such equipment may damage the processing equipment and may be difficult to maintain. In addition, the equipment utilized in these processes is often not thermally efficient and may therefore not be commercially viable.

As a result, there is a need in the industry for an improved process for upgrading a low rank coal and a heavy oil to produce both an improved coal product and an improved oil product while minimizing both the loss of hydrocarbons and the effects of the first and second stages of stickiness that may be exhibited while performing known upgrading processes.

DISCLOSURE OF INVENTION

The present invention relates to an improved process for upgrading a low rank coal and a heavy oil to produce an improved coal product and an improved oil product. The invention includes the step of dewatering the low rank coal to reduce its moisture content, prior to mixing it with the heavy oil to form a mixture, in order to render the low rank coal more oleophilic. This enables the low rank coal and heavy oil to be more readily mixed. The enhanced degree of mixing may promote higher recovery of the improved oil product. Further, dewatering of the low rank coal may minimize the loss of hydrocarbons and the effects and disadvantages of the first stage of stickiness which typically occurs during dewatering of the mixture itself, as is performed in the prior processes. The effects and disadvantages of the second stage of stickiness of the mixture may also be minimized using the present invention during subsequent heating of the mixture through the sticky temperature zone. The process may be performed in conventional equipment known in the industry. Further, the improved process may produce a relatively high yield of the improved oil product while resulting in a loss of a relatively low amount of the low rank coal used for the process.

In one aspect of the invention, the invention comprises a process for upgrading a low rank coal and a heavy oil to produce an improved coal product and an improved oil product. The process is comprised of the steps of: dewatering the low rank coal to reduce the moisture content of the low rank coal to less than about 4% in order that the low rank coal is rendered more oleophilic; mixing the dewatered low rank coal with a quantity of the heavy oil of between about 15 and 40 percent of the dry weight of the low rank coal so that the heavy oil substantially contacts the low rank coal in order to produce a mixture; heating the mixture to a temperature less than the mild thermal cracking limit of the mixture to separate hydrocarbons from the mixture and to produce the improved coal product; and collecting the hydrocarbons separated from the mixture during the heating step to produce the improved oil product.

In the first aspect, the moisture content of the low rank coal is preferably reduced to about 2 percent prior to the mixing step. The quantity of the heavy oil is preferably between about 16 and 25 percent of the dry weight of the low rank coal. Further, the dewatering step may be performed at least in part by heating the low rank coal to a temperature of about the boiling point of water at the ambient pressure. The mixing step may be comprised of mechanically mixing the dewatered low rank coal and the heavy oil. The mixing step may also be performed at a temperature of about the boiling point of water at the ambient pressure.

The low rank coal may be selected from the group consisting of sub-bituminous coal and lignitic coal and may be comprised of particles having a size of about 28 mesh X 0. As well, the particles may have a D50 particle size in the range of between about 150 and 250 microns. The heavy oil may be less than about 15° API, or preferably about 12° API.

The process may be further comprised of the step of cleaning the low rank coal prior to the dewatering step in order to separate the particles of the low rank coal from any particles of gangue intermixed with the particles of the low rank coal.

The process may also be further comprised of the step of stripping the mixture throughout the heating step. The heating step may be performed in an inert gas environment. The inert gas may be steam. The stripping step may be comprised of inert gas stripping at approximately atmospheric pressure. Again, the inert gas may be steam.

The heating step may be comprised of the steps of heating a vessel and placing the mixture in the vessel such that the mixture is in contact with the inner surface of the vessel. Preferably, the vessel is heated such that the inner surface of the vessel has a temperature greater than the sticky temperature zone and less than the mild thermal cracking limit of the mixture. The vessel may be a rotary kiln and the heating of the vessel may be comprised of indirectly firing the rotary kiln. Preferably, the heating step is further comprised of the steps of heating ceramic balls in a supporting ball heater and circulating the heated ceramic balls within the mixture when the temperature of the mixture exceeds the sticky temperature zone.

BRIEF DESCRIPTION OF DRAWINGS

Embodiments of the invention will now be described with reference to the accompanying drawings in which.

BEST MODE OF CARRYING OUT INVENTION

Figure 1:
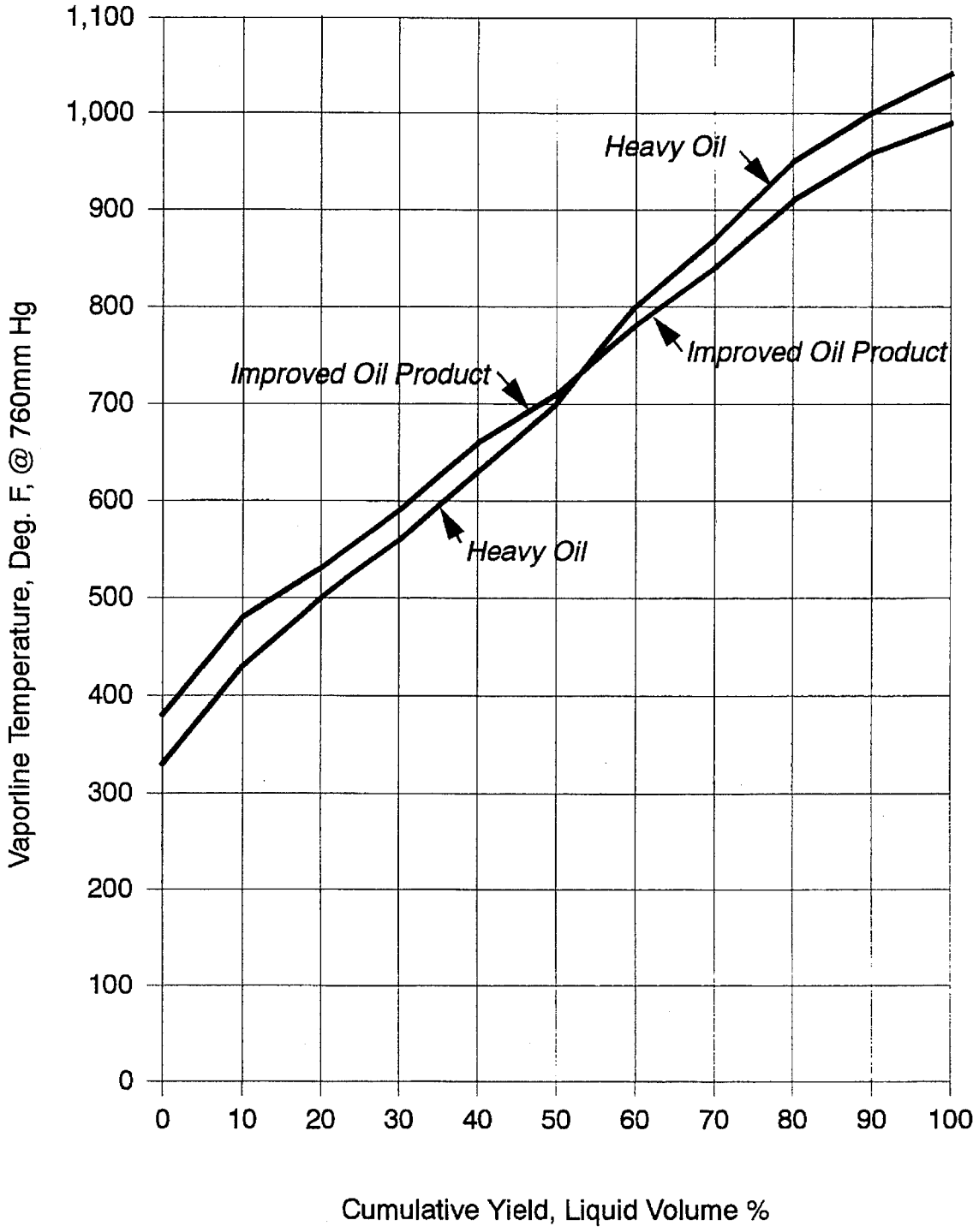
FIG. 1 is a graph showing the boiling curves of a heavy oil and an improved oil product.

The invention comprises a process for upgrading a low rank coal and a heavy oil. The low rank coal is defined as coal of a lower grade than bituminous, being preferably sub-bituminous or lignitic coal, and having a heating value below approximately 5,000 cal/gm. The low rank coal is prepared for the process by crushing and grinding by well-known processes. The particles of low rank coal may be of any size. However, a balance is preferably sought between: larger particles, which require more time to transfer heat and mass than smaller particles and are therefore less economical; and smaller particles, which limit the vapour velocity in the process equipment and are more susceptible to dusting than larger particles. Very fine particles may cause dusting within the kilns. The dust may be carried into the gas stream and may contaminate the improved oil product. As well, dusting of the particles may result in autoignition of the low rank coal. Therefore dusting is preferably minimized at all times throughout the process. An economical balance may be achieved between particle size, heat transfer, and vapour velocity by utilizing low rank coal which has been crushed to a size of about 28 mesh X 0, with a D50 particle size ranging from about 150 to 250 microns. Low rank coal particles in this size range, and in particular, particles at the coarse end of this size range, are preferred for use in the process. However, the process will work through a much wider particle size distribution range.

The heavy oil used in the process is defined as oil having less than 15° API with an initial boiling point of greater than 120° C., including bitumen, heavy crude and other oils recognized in the art as heavy oils. Preferably, the heavy oil has about 12° API.

In the preferred embodiment, the first step in the process is comprised of cleaning the low rank coal in order to separate the particles of low rank coal from particles of gangue intermixed with the particles of low rank coal. The low rank coal may be cleaned by any known processes for cleaning low rank coal, such as screening or froth flotation processes for low rank coal. However, cleaning processes such as agglomeration processes involving the addition of a significant amount of oil should be avoided because they may cause the low rank coal to be sticky, or promote the occurrence of the first stage of stickiness, during the dewatering step of the present invention.

Following cleaning of the low rank coal, the low rank coal is dewatered to reduce its moisture content in order that the low rank coal is rendered more oleophilic. If the low rank coal is not dewatered, it tends to be somewhat oleophobic. However, if the low rank coal is dewatered, it is rendered more oleophilic. The low rank coal may be rendered more oleophilic because the dewatering step eliminates the water which would otherwise repel the heavy oil. As a result, upon mixing the heavy oil with the low rank coal, the heavy oil tends to make greater contact with the low rank coal. This contact appears to allow the heavy oil to physically or chemically interact with the low rank coal. As a result of this apparent interaction, the yield of the improved oil product from the within process may be greater than the yield of the improved oil product from a mixture using non-dewatered low rank coal, when heated to the same temperature.

Further, during conventional processes which heat the mixture of heavy oil and non-dewatered low rank coal from the ambient temperature, hydrocarbons may be lost as a result of the evaporation of water contained in the mixture, including water or moisture contained in the non-dewatered low rank coal. A significant amount of hydrocarbons may be lost with the vented steam. Dewatering of the low rank coal prior to the mixing step may assist in minimizing any such loss of hydrocarbons. The minimization of this loss may be a contributing factor to the increased yield of improved oil product from a mixture containing dewatered low rank coal as compared to non-dewatered low rank coal, as set out above.

Finally, pilot plant testing has shown that as a mixture containing non-dewatered low rank coal is heated from the ambient temperature to the final process temperature, the mixture can exhibit a first stage of stickiness at the temperature of the boiling point of the water in the mixture at ambient pressure. If the low rank coal is dewatered prior to the mixing step to reduce its moisture content, this first stage of stickiness may be minimized or avoided completely.

To be effective in rendering the low rank coal sufficiently oleophilic, limiting the loss of hydrocarbons, and minimizing the first stage of stickiness, the moisture content of the low rank coal is reduced by the dewatering step to less than about 4 percent, and preferably to about 2 percent.

Dewatering may be achieved mechanically, thermally or by a combination thereof. Mechanical dewatering may be performed by air drying or gravity drainage, basket or screen bowl centrifuging or filtering. Thermal dewatering may be performed by heating the low rank coal in fluid bed dryers or rotary kiln type dryers depending upon, amongst other factors, the capacity of the operation, the qualities or characteristics of the low rank coal used, and the amount of dewatering required. Mechanical dewatering will, however, typically remove only free surface water. In addition, the reduction of the moisture content of the low rank coal below its equilibrium level can only be accomplished effectively by thermal dewatering. As a result, the dewatering step is preferably performed by thermally dewatering the low rank coal. However, any manner of dewatering capable of achieving the necessary moisture content level may be used.

In the preferred embodiment, the dewatering step is performed by heating the low rank coal to a temperature of about the boiling point of water at the ambient pressure in order to effectively reduce the moisture content of the low rank coal. The temperature of the low rank coal will typically not increase significantly above that temperature until substantially all of the water contained therein is evaporated. To aid in limiting the time required for the dewatering step to effectively reduce the moisture content to the preferred level, the mixture may be first dewatered mechanically to remove any free surface water. The mechanically dewatered low rank coal may then be thermally dewatered to the final desired moisture content.

The dewatered low rank coal and the heavy oil are then mixed to form a mixture. The low rank coal and the heavy oil are mixed mechanically using commercially available mixers. The quantity of the heavy oil used in the mixture may vary between about 15 and 40 percent of the dry weight of the low rank coal so that the heavy oil may contact and interact with the low rank coal to produce the improved coal and oil products. Preferably the quantity of heavy oil used is between about 16 and 25 percent in order to obtain the best yield of the improved oil product.

To aid the mixing step, the heavy oil and the subsequently formed mixture may be heated to reduce their respective viscosities. However, the heavy oil and the mixture should be heated to a temperature less than the temperatures at which significant hydrocarbons will separate from the heavy oil and the mixture respectively. The heavy oil is preferably heated to a temperature just below its initial boiling point, being the boiling point of its lightest fractions, in order to reduce its viscosity and improve its handling and mixing characteristics. Different heavy oils will have different initial boiling points. The mixture is preferably heated to a temperature of about the boiling point of water at the ambient pressure.

Following the mixing step, the mixture is heated through the sticky temperature zone described below to a temperature less than the mild thermal cracking limit of the mixture in order to separate hydrocarbons from the mixture and to produce the improved coal product. The separated hydrocarbons are then collected and condensed to produce the improved oil product.

Excess or severe thermal cracking of the mixture takes place at approximately 450° C. and results in a low quality oil product having a high olefin content which requires hydrogenation to be stabilized. Excess or severe thermal cracking is therefore avoided by limiting the temperature in the heating step to less than the mild thermal cracking temperature of the mixture. The mild thermal cracking temperature of the mixture is typically about 390° C. to 420° C. At just below this temperature, both bench scale and pilot plant testing have indicated that a high yield of the improved oil product is produced. Testing has indicated that the combined yields of hydrocarbons produced from the low rank coal and the heavy oil individually would be about half of the hydrocarbons produced from the mixture at the same temperature. Thus, there appears to be a beneficial physical or chemical interaction between the heavy oil and the low rank coal.

The preferred maximum temperature of the mixture during the heating step is also determined by and dependent upon the final desired quality of the improved oil product. Preferably, the temperature during the heating step should be monitored and regulated to produce an improved oil product having a bromine number less than about 30, a nitrogen content of less than about 2,000 p.p.m., a diene number of less than about 2.6, reduced sulphur and heavy metal content, an API gravity of about 20°, and an aromatics content of about 22 to 36 percent of the improved oil product. Generally, as the temperature of the mixture increases, the bromine number of the improved oil product increases, its nitrogen content increases and its diene number increases. As well, aromatic bonds tend to be broken which may result in the improved oil product becoming unsaturated and unstable, which is undesirable for further upgrading. The higher the bromine number, the more hydrogen is required for the heavy oil to be refined, and the less valuable the crude oil. The olefin content of the heavy oil is measured by the diene number. The value of the improved oil product decreases as its diene number increases, indicating an increase in the olefin content. The value of the improved oil product also decreases as its nitrogen content increases. Increased nitrogen content typically requires greater quantities of hydrogen during refining. Increased sulphur content of the improved oil product typically increases the amount of corrosion in the refinery, which decreases the value of the improved oil product, and increases the sulphur content of the refinery bottoms or coke.

Test results indicate that regardless of the specific composition of the mixture, the mixture exhibits a second stage of stickiness during the heating step throughout the sticky temperature zone. The sticky temperature zone is typically between about 180° C. and 260° C. As the mixture is heated, at about 180° C., the mixture will become sticky and adhere to the unheated walls of the heating vessel. This renders the mixture difficult to process and may require the use of mechanical scraping devices which can damage processing equipment and which are difficult to maintain. At temperatures greater than about 260° C., the mixture becomes hot enough that its viscosity is reduced and stickiness is no longer a problem. Preferably, steps are taken, as set out below, to minimize any problems which may arise during the heating step due to the second stage of stickiness of the mixture exhibited during the sticky temperature zone.

Although the sticky temperature zone is approximately the same for all compositions of the mixture, the temperature of the mixture alone should not be relied upon to determine the sticky temperature zone. A stickiness profile should be established for each specific mixture utilizing a "dip stick" stickiness test. One method of conducting such a test is to remove one of the thermocouples from the reactor or the kiln and examine it. If significant amounts of the mixture adhere or stick to the thermocouple, the mixture may be considered to be within the sticky temperature zone.

The heating step includes the steps of heating a vessel, preferably a rotary kiln, and placing the mixture in the rotary kiln such that the mixture is in contact with its inner surface. In order to minimize the problems associated with the second stage of stickiness within the sticky temperature zone, the inner surface of the rotary kiln is preferably maintained throughout the heating step at a temperature greater than the sticky temperature zone. Further, the inner surface is maintained at a temperature less than the mild thermal cracking limit of the mixture.

A rotary kiln is the preferred equipment for performing the heating step as it provides a relatively efficient means of heat transfer. As well, the rotary kiln will continue to mix the mixture as it is heated such that a fairly uniform temperature can be maintained throughout the mixture. Although either a direct fired or indirect fired rotary kiln may be utilized, an indirect fired kiln is preferred. An indirect fired kiln involves heating of the kiln walls such that solid to solid heat transfer occurs at the point of contact between the mixture and the kiln walls.

The temperature differential between the mixture and the rotary kiln is preferably controlled throughout the heating step as higher temperature differentials may result in greater temperature differentials within the mixture, which may cause mild or severe thermal cracking of the mixture before the desired heat is absorbed into the mixture. As well, to minimize dusting during the heating step, the vapour velocity within the kiln is preferably limited to less than about 175 meters per minute.

Once the mixture exceeds the temperature of the sticky temperature zone, a supporting ball heater, such as a further separate rotary kiln, is preferably used in combination with the rotary kiln previously described. The ball heater uses a circulating load of balls. The balls are heated in the supporting ball heater and then transferred to the rotary kiln to be circulated within the mixture. The balls permit greater solid to solid heat transfer over a much greater surface area than that of the rotary kiln alone. The ball heater may use either ceramic or metal balls, however, ceramic balls are preferred. Ceramic balls have approximately 2.5 times the heat carrying capacity of metal and are approximately half the weight. As well, ceramic balls tend to have less of a grinding effect on the mixture than metal balls. Grinding should be minimized in order to avoid dusting and possible ignition. The balls should be of a uniform size and a high ball to mixture ratio should be used to decrease the amount of grinding as the particles of mixture will remain in the interstices of the balls. Although the balls may carry a small quantity of coal or coke during the heating step, this does not present a problem as the coal or coke can be burned off the balls during their reheating in the ball heater, thus providing some part of the fuel for the ball heater. However, care must be taken not to fracture the ceramic balls during their reheating.

A fluidized bed shaft furnace having a heated inner surface may also be utilized for the heating step. A tall, small diameter shaft furnace allows the mixture to be lifted in the inert gas environment through the shaft. The shaft should have a sufficient height to allow heating of the mixture to a temperature near the mild thermal cracking limit of the mixture. The inner surface of the shaft should preferably be heated to a temperature above the sticky temperature zone and below the mild thermal cracking limit of the mixture. An indirect fired rotary kiln is generally preferred to the shaft furnace because it may be easier to operate than the shaft furnace. However, a shaft furnace may be preferred where higher percentages of heavy oil in the mixture are being used so that the mixture does not stick to the metal surfaces since retention time and metal to surface contact are limited in a shaft furnace.

Preferably, stripping of the mixture should be carried out throughout the heating step. The mixture is preferably stripped with inert gas to enhance and facilitate separation of the hydrocarbons from the mixture. Inert gas in this context includes combustion gas, steam, and any elements commonly known as inert gases, such as nitrogen. Combustion gas may be used as it is comprised primarily of nitrogen and carbon dioxide and is relatively inert. Steam stripping of the mixture is however preferred because the hydrocarbons separated from the mixture may condense onto the water droplets. This is important since the separated hydrocarbons are collected and condensed later in the process. At that time, the water droplets provide a nucleus for condensation of the hydrocarbons. Nitrogen and other inert gases will strip the hydrocarbons from the mixture, however, due to their partial pressures, they cannot be readily condensed. Steam stripping is also preferred because it aids in controlling the atmosphere within the kiln by inhibiting dusting and combustion within the kiln. Vacuum stripping, or a combination of vacuum and inert gas stripping, may also be used. However, since vacuum stripping must be performed under vacuum, sealing of the rotary kiln becomes a consideration which often adds to the cost of the necessary equipment and process operations. Inert gas stripping is conducted at approximately atmospheric pressure and therefore sealing of the rotary kiln is not necessary. The processes for stripping are well-known in the art as described in U.S. Pat. Nos. 4,396,396 and 4,415,335.

The heating step is also preferably performed in an inert gas environment to minimize the presence of oxygen and thus avoid combustion of the mixture during the step. Inert gas for this purpose includes combustion gas, steam, and any elements commonly known as inert gases, such as nitrogen. A steam environment is preferred during these steps for the same reasons that steam stripping is preferred.

As indicated, the improved coal product is formed during the heating step. The improved coal product left behind after separation of the hydrocarbons during the heating step is then cooled, preferably using a conventional coke drum followed by a water jacketed rotary kiln.

The improved coal product appears to have several desirable qualities. The low rank coal moisture content may be reduced by the process and by accepting some of the undesirable components of the heavy oil, such as its asphaltenes, the improved coal product is sealed so that moisture re-absorption and adsorption may be limited and therefore it may be less likely to autoignite. Testing has shown that the equilibrium moisture content of the low rank coal may be significantly reduced in the improved coal product. This occurs as the undesirable heavy oil components seal the pores of the improved coal product. In addition, the undesirable components of the heavy oil which are deposited in the low rank coal are generally in low enough concentrations to be suitable for thermal combustion in the improved coal product. In particular, since many low rank coals are very low in sulphur, the slightly higher sulphur content of the improved coal product is typically far below acceptable limits for thermal combustion. As a result, a higher heating value solid fuel may be produced which has a lower equilibrium moisture content and therefore reduced hygroscopicity.

Finally, the hydrocarbons separated from the mixture during the heating step are collected and condensed to produce the improved oil product. The hydrocarbon and water vapours are cycloned and filtered to remove most of the solids which may be carried over with the vapours. The hydrocarbon and water vapours are subsequently condensed and separated. All of these refinement processes result in the production of the improved oil product.

The improved oil product appears to have several desirable qualities. As indicated previously, some of the undesirable components of the heavy oil including its asphaltenes, some of its sulphur and some of its heavy metals, are deposited on the low rank coal. The heavy metals are concentrated in the asphaltenes of the heavy oil. As asphaltenes do not boil at the lower temperature used in the process, they are deposited on the low rank coal and the improved oil product may contain significantly less amounts of heavy metals than the heavy oil. Heavy metals are generally detrimental for further refinery upgrading operations. As well, the lighter volatile fraction of the low rank coal is produced as light oil which may have a higher °API, which can be more readily hydrotreated during subsequent refinery operations to transportation fuels quality. Thus, the heavy oil is upgraded to an improved oil product that is typically lower in sulphur, heavy metals, and asphaltenes than the heavy oil. The improved oil product also tends to have a lower viscosity and higher °API than heavy oil such that it is relatively easier to transport through a pipeline.

The boiling curves for a typical heavy oil and improved oil product are shown in FIG. 1. The curves show that the improved oil product components which boil below 370° C. are heavier than those of the original heavy oil, and those above 370° C. are lighter than the original heavy oil. Therefore the refinery yields of the most desirable components, those in the middle of the boiling curve, will be higher. Further, the larger molecules in the low rank coal and the heavy oil are broken into smaller molecules which boil at lower temperatures.

As well, with normal thermal cracking, the low rank coal and the heavy oil would have high bromine and diene numbers. However, the process produces improved products with typically less than 25 bromine number and 2.6 diene number. Further, testing has shown that in some cases, the nitrogen remaining in the improved oil product is more easily stripped from the improved oil product during subsequent hydrotreating than would normally be expected from heavy oil. This phenomenon may be due to a weakening or loosening of the nitrogen bond in the improved oil product.

The following example serves more fully to illustrate the invention:

EXAMPLE

The process described above was performed with a mixture of a low rank coal and a heavy oil having the quality and characteristics set out below. The test described below was run in a 200 kg/hour pilot plant for a period of 70 hours.

| Low Rank Coal Quality | |
|---|---|
| Origin | Genesee Coal Field, Alberta, Canada |
| Moisture weight % (as received) | 20.0 |
| Ash weight % (dry basis) | 16.7 |
| Volatile Matter weight % (dry basis) | 32.4 |
| Fixed Carbon weight % (dry basis) | 50.9 |
| Sulphur weight % | 0.4 |
| Heating Value (cal/gm) (db) | 4,445.0 |
| Rank | Sub-bituminous C |
| D50 Particle Size Distribution | 160 microns |

| Heavy Oil Quality | |
|---|---|
| Origin | Elk Point, Alberta, Canada |
| API Gravity | 12.2° |
| S.G. at 15° C. | 0.997 |
| Sulphur weight % | 4.2 |
| Residuum +525° C. weight % | 51.2 |
| Crude Type | Heavy |

Mixture

Sub-bituminous coal mixed with:

20.5 weight % heavy oil (based on surface dry weight of the low rank coal)

| Yield Profile (weight percent) | | | |
|---|---|---|---|
| Description | Mixture | Improved Products | Cooled Improved Coal Product |
| Coal | 63.6 | 99.1 | 91.2 |
| Oil in Coal | 20.5 | .9 | .8 |
| Water | 15.9 | 0.0 | 8.0 |
| Temperature °C. | 40.0 | 410.0 | 70.0 |
| Oil Yield (vol. %) | 0.0 | 106.7 | 0.0 |

The improved coal and oil products produced by the process have the following qualities:

| Improved Coal Product (Typical Pilot Plant and Bench Scale Results) | |
|---|---|
| Moisture weight % | 8 |
| Ash content weight % | 7–10 |
| Volatile Matter weight % | 22–24 |
| Fixed Carbon weight % | 57–62 |
| Sulphur weight % | 0.75–0.85 |
| Heating Value (cal/gm) | 6435 |

| Improved Oil Product (Pilot Plant Run) | |
|---|---|
| Yield, Volume % | 106.7 |
| API Gravity | 19.1 |
| S.G. at 15° C. | 0.9398 |
| Composition | |
| Carbon residue, Ramsbottom, ASTM D-524 | 0.98 weight % |
| Silicon, ICP | 0.6 weight % |
| Chloride, total, microcoulometry | <1 ppm weight |
| Nitrogen, total, ASTM 4629 | 1190 ppm weight |
| Sulphur, total, ASTM D-4294 | 2.11 weight % |
| Oxygen, Carlo Erba 1106 | 4.1 weight % |
| Residuum, +525° C. weight %, AST D-1160 | 7.0 weight % |
| Bromine Number (average) | 22 |

-continued

| | |
|---|---|
| Diene Number | 2.5 |
| Heavy Metals | |
| Iron, total, ICP | 4.4 |
| Nickel, total ICP | <0.2 ppm weight |
| Vanadium, total, ICP | 2.0 ppm weight |
| Typical Elemental Composition | |
| Carbon, weight % | 84.3 |
| Hydrogen, weight % | 10.7 |
| Nitrogen, mg/L | 1125 |
| Sulphur, weight % | <2.45 |

The embodiments of the invention in which an exclusive property or privilege is claimed are defined as follows:

1. A process for upgrading a low rank coal and a heavy oil to produce an improved coal product and an improved oil product comprising the steps of:

(a) dewatering the low rank coal to reduce the moisture content of the low rank coal to less than about 4 percent in order that the low rank coal is rendered more oleophilic;

(b) mixing the dewatered low rank coal with a quantity of the heavy oil of between about 15 and 40 percent of the dry weight of the low rank coal so that the heavy oil substantially contacts the low rank coal in order to produce a mixture;

(c) heating the mixture to a temperature less than the mild thermal cracking limit of the mixture to separate hydrocarbons from the mixture and to produce the improved coal product; and (d) collecting the hydrocarbons separated from the mixture during the heating step to produce the improved oil product.

2. The process as claimed in claim 1 wherein the moisture content of the low rank coal is reduced to about 2 percent.

3. The process as claimed in claim 2 wherein the quantity of the heavy oil is between about 16 and 25 percent of the dry weight of the low rank coal.

4. The process as claimed in claim 3 wherein the dewatering step is performed at least in part by heating the low rank coal to a temperature of about the boiling point of water at the ambient pressure.

5. The process as claimed in claim 1, further comprising the step of cleaning the low rank coal prior to the dewatering step in order to separate the particles of the low rank coal from any particles of gangue intermixed with the particles of the low rank coal.

6. The process as claimed in claim 1, further comprising the step of stripping the mixture throughout the heating step.

7. The process as claimed in claim 6 wherein the heating step is performed in an inert gas environment.

8. The process as claimed in claim 7 wherein the stripping step is comprised of inert gas stripping at approximately atmospheric pressure.

9. The process as claimed in claim 7 wherein the inert gas is steam.

10. The process as claimed in claim 1, wherein the mixing step is comprised of mechanically mixing the dewatered low rank coal and the heavy oil.

11. The process as claimed in claim 10 wherein the mixing step is performed at a temperature of about the boiling point of water at the ambient pressure.

12. The process as claimed in claim 1, wherein the low rank coal is selected from the group consisting of subbituminous coat and lignitic coal.

13. The process as claimed in claim 12 wherein the low rank coal is comprised of particles having a size of about 28 mesh X 0.

14. The process as claimed in claim 13 wherein the low rank coal is comprised of particles having D50 particle size in the range of between about 150 and 250 microns.

15. The process as claimed in claim 1 wherein the heavy oil has an API gravity of less than about 15.

16. The process as claimed in claim 15 wherein the heavy oil has an API gravity of about 12.

17. The process as claimed in claim 1, wherein the heating step is comprised of the steps of heating a vessel and placing the mixture in the vessel such that the mixture is in contact with the inner surface of the vessel.

18. The process as claimed in claim 17 wherein the vessel is heated such that the inner surface of the vessel has a temperature greater than the sticky temperature zone and less than the mild thermal cracking limit of the mixture.

19. The process as claimed in claim 18 wherein the vessel is a rotary kiln and the heating of the vessel is comprised of indirectly firing the rotary kiln.

20. The process as claimed in claim 18 wherein the heating step is further comprised of the steps of heating ceramic balls in a supporting ball heater and circulating the heated ceramic balls within the mixture when the temperature of the mixture exceeds the sticky temperature zone.

21. The process as claimed in claim 1 wherein the quantity of the heavy oil is between about 16 and 25 percent of the dry weight of the low rank coal.

22. The process as claimed in claim 1 wherein the dewatering step is performed at least in part by heating the low rank coal to a temperature of about the boiling point of water at the ambient pressure.

23. The process as claimed in claim 2 wherein the dewatering step is performed at least in part by heating the low rank coal to a temperature of about the boiling point of water at the ambient pressure.

24. The process as claimed in claim 2 further comprising the step of cleaning the low rank coal prior to the dewatering step in order to separate the particles of the low rank coal from any particles of gangue intermixed with the particles of the low rank coal.

25. The process as claimed in claim 8 wherein the inert gas is steam.

26. The process as claimed in claim 2 further comprising the step of stripping the mixture throughout the heating step.

27. The process as claimed in claim 26 wherein the heating step is performed in an inert gas environment.

28. The process as claimed in claim 27 wherein the stripping step is comprised of inert gas stripping at atmospheric pressure.

29. The process as claimed in claim 27 wherein the inert gas is steam.

30. The process as claimed in claim 28 wherein the inert gas is steam.

31. The process as claimed in claim 2 wherein the mixing step is comprised of mechanically mixing the dewatered low rank coal and the heavy oil.

32. The process as claimed in claim 31 wherein the mixing step is performed at a temperature of about the boiling point of water at the ambient pressure.

33. The process as claimed in claim 2 wherein the low rank coal is selected from the group consisting of subbituminous coal and lignitic coal.

34. The process as claimed in claim 33 wherein the low rank coal is comprised of particles having a size of about 28 mesh X 0.

35. The process as claimed in claim 34 wherein the low rank coal is comprised of particles having D50 particle size in the range of between about 150 and 250 microns.

36. The process as claimed in claim 2 wherein the heavy oil has an API gravity of about 15.

37. The process as claimed in claim 36 wherein the heavy oil has an API gravity of about 12.

38. The process as claimed in claim 19 wherein the heating step is further comprised of the steps of heating ceramic balls in a supporting ball heater and circulating the heated ceramic balls within the mixture when the temperature of the mixture exceeds the sticky temperature zone.

39. The process as claimed in claim 2 wherein the heating step is comprised of the steps of heating a vessel and placing the mixture in the vessel such that the mixture is in contact with the inner surface of the vessel.

40. The process as claimed in claim 39 wherein the vessel is heated such that the inner surface of the vessel has a temperature greater than the sticky temperature zone and less than the mild thermal cracking limit of the mixture.

41. The process as claimed in claim 40 wherein the vessel is a rotary kiln and the heating of the vessel is comprised of indirectly firing the rotary kiln.

42. The process as claimed in claim 40 wherein the heating step is further comprised of the steps of heating ceramic balls in a supporting ball heater and circulating the heated ceramic balls within the mixture when the temperature of the mixture exceeds the sticky temperature zone.

43. The process as claimed in claim 41 wherein the heating step is further comprised of the steps of heating ceramic balls in a supporting ball heater and circulating the heated ceramic balls within the mixture when the temperature of the mixture exceeds the sticky temperature zone.

* * * * *

UNITED STATES PATENT AND TRADEMARK OFFICE

CERTIFICATE OF CORRECTION

PATENT NO. : 5,503,646

DATED : April 12, 1996

INVENTOR(S) : Colin J. McKenny, et al.

It is certified that error appears in the above-identified patent and that said Letters Patent is hereby corrected as shown below:

At Column 11, line 25, delete "substantially"

At Column 11, line 52, delete "approximately"

Signed and Sealed this

Sixth Day of August, 1996

Bruce Lehman

*Attest:*

BRUCE LEHMAN

*Attesting Officer*

*Commissioner of Patents and Trademarks*